United States Patent [19]

Baker et al.

[11] Patent Number: 4,827,881

[45] Date of Patent: May 9, 1989

[54] ENGINE OIL PUMP

[75] Inventors: Charles R. Baker, Pontiac; Albert B. Nelson, Oxford, both of Mich.

[73] Assignee: Saturn Corporation, Troy, Mich.

[21] Appl. No.: 200,810

[22] Filed: Jun. 1, 1988

[51] Int. Cl.[4] ..... F01M 1/00

[52] U.S. Cl. ..... 123/196 R; 123/198 C; 184/26

[58] Field of Search ..... 123/196 R, 198 C, 196 AB; 184/104.2, 26

[56] References Cited

U.S. PATENT DOCUMENTS

| | | | |
|---|---|---|---|
| 3,942,503 | 3/1976 | Hanaoka et al. | 123/196 AB |
| 4,122,818 | 10/1978 | Hattori | 123/196 AB |
| 4,295,807 | 10/1981 | Kruger | 418/170 |
| 4,449,491 | 5/1984 | Tsuchiyama et al. | 123/90.34 |

*Primary Examiner*—E. Rollins Cross
*Attorney, Agent, or Firm*—Saul Schwartz

[57] ABSTRACT

An oil pump for an internal combustion engine includes an annular boss on a front cover of the engine, a counterbore in the front cover behind the boss, crankshaft driven oil pump elements in the counterbore, and a planar closure plate attached to the front cover over the counterbore and capturing the pump elements. The closure plate has a pair of raised protuberances thereon which span the chain drive chamber of the engine behind the front cover and which straddle the chain within the chamber, each of the protuberances having a flat wall around respective ones of a pair of ports in the closure plate. One of the ports is connected to the pump intake and the other is connected to the pump discharge. A pair of face seal assemblies on the cylinder block of the engine around low and high pressure galleries engage the flat walls of the protuberances when the front cover is installed on the cylinder block and define fluid seals around the ports.

5 Claims, 3 Drawing Sheets

ENGINE OIL PUMP

FIELD OF THE INVENTION

This invention relates to oil pumps for internal combustion engines.

BACKGROUND OF THE INVENTION

In a typical crankshaft mounted oil pump for an internal combustion engine, an internally lobed or toothed pump element is rotatably supported on a front cover of the engine around the front end of the crankshaft. An externally lobed or toothed pump element attached to the front end of the crankshaft nests within and meshes with the internally lobed or toothed element. Where the engine has a chain driven camshaft and belt driven accessories, the chain drive sprocket on the crankshaft, the crankshaft mounted oil pump, and the crankshaft mounted accessory drive pulley are all stacked at the end of the crankshaft and the stacked dimension of the three units contributes to the overall length of the engine. In a transverse engine installation where engine and transmission are arranged end-to-end, in contrast to the more typical transverse side-by-side configuration, the overall length of the engine must be minimized. An oil pump according to this invention minimizes the stacked dimension of the chain drive sprocket, the oil pump, and the belt drive pulley and is, therefore, particularly attractive for the aforesaid end-to-end transverse engine/transmission applications.

BRIEF SUMMARY OF THE INVENTION

This invention is a new and improved oil pump for an internal combustion engine. The engine is conventional in the sense that it includes a crankshaft rotatably supported on a cylinder block, a front cover on the cylinder block forming with the latter a chamber for a drive chain, a chain drive sprocket on the crankshaft within the drive chain chamber, and an accessory drive pulley on the crankshaft outside the front cover. A crankshaft mounted oil pump according to this invention is disposed between the chain drive sprocket and the accessory drive pulley in a boss in the front cover which boss nests within the pulley so that the oil pump is located substantially in the plane of the accessory drive belt. The oil pump according to this invention has inlet and discharge ducts spanning the drive chain chamber and straddling the drive chain for optimum utilization of available space within the chamber housing the chain and, in a preferred embodiment of the oil pump according to this invention, the oil intake and oil discharge ducts are formed integrally with a cover plate of the oil pump.

DESCRIPTION OF PREFERRED EMBODIMENT

Figure 1:
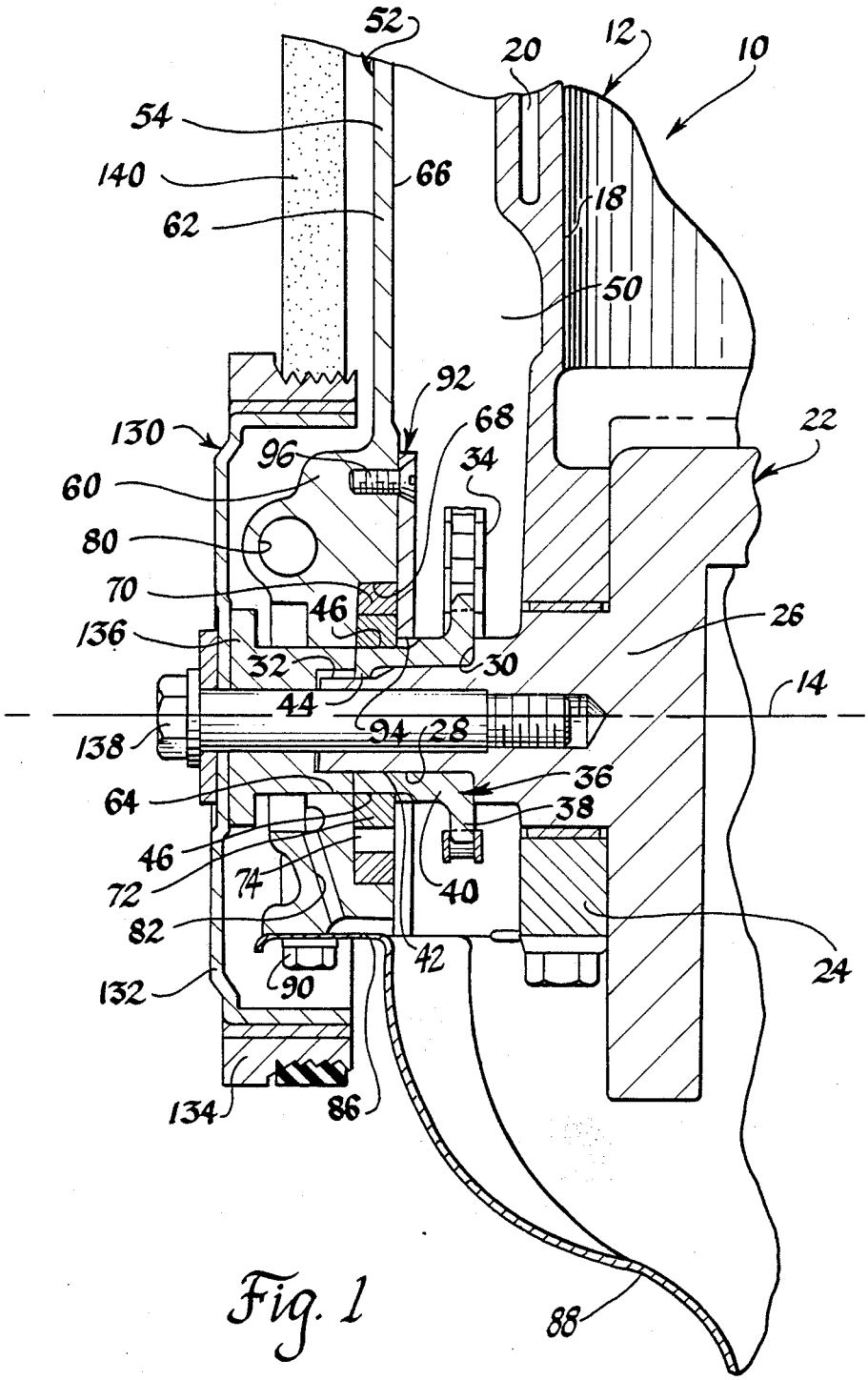
FIG. 1 is a fragmentary sectional view in elevation of an internal combustion engine having an oil pump according to this invention.

Referring to the drawings, an internal combustion engine 10 includes a cylinder block 12 defining a crankshaft axis 14. The cylinder block has a generally planar front wall or face 16, FIG. 2, perpendicular to the axis 14 and a plurality of cylinder bores above the axis 14, only a first cylinder bore 18 surrounded by a portion of a water jacket 20 of the cylinder block being partially illustrated in FIG. 1.

A crankshaft 22 is supported on the cylinder block, as by a front main bearing cap 24, for rotation about the axis 14. The crankshaft has a front stem portion 26 extending forwardly beyond the plane of the front face 16 of the cylinder block and aligned on the axis 14. The stem portion 26 has a cylindrical outside surface 28 extending from the distal end of the stem portion to an annular shoulder 30 and a slot 32, FIG. 1, in the outside surface extending from the distal end toward the shoulder 30.

The camshaft, not shown, of the engine is driven by the crankshaft 22 through a chain 34 and a chain drive sprocket 36. The sprocket 36 has a plurality of teeth 38 which mesh with the interstices of the chain 34 and which project radially out from a cylindrical body 40 of the sprocket. The sprocket body 40 is closely received on the outside surface 28 of the stem portion 26 and has an outside surface 42, FIG. 3. An inwardly extending lug 44 on the sprocket body 40 is received in the slot 32 in the stem portion of the crankshaft whereby the sprocket 36 is connected to the crankshaft 22 for unitary rotation about axis 14. The installed position of the sprocket 36 on the crankshaft is established by engagement of the lug 44 in the slot 32 and by engagement of the sprocket on the annular shoulder 30 on the crankshaft. The outside surface 42 of the sprocket has a pair of diametrically opposite milled flats 46 thereon, FIGS. 1 and 3, for a purpose described below.

Figure 2:
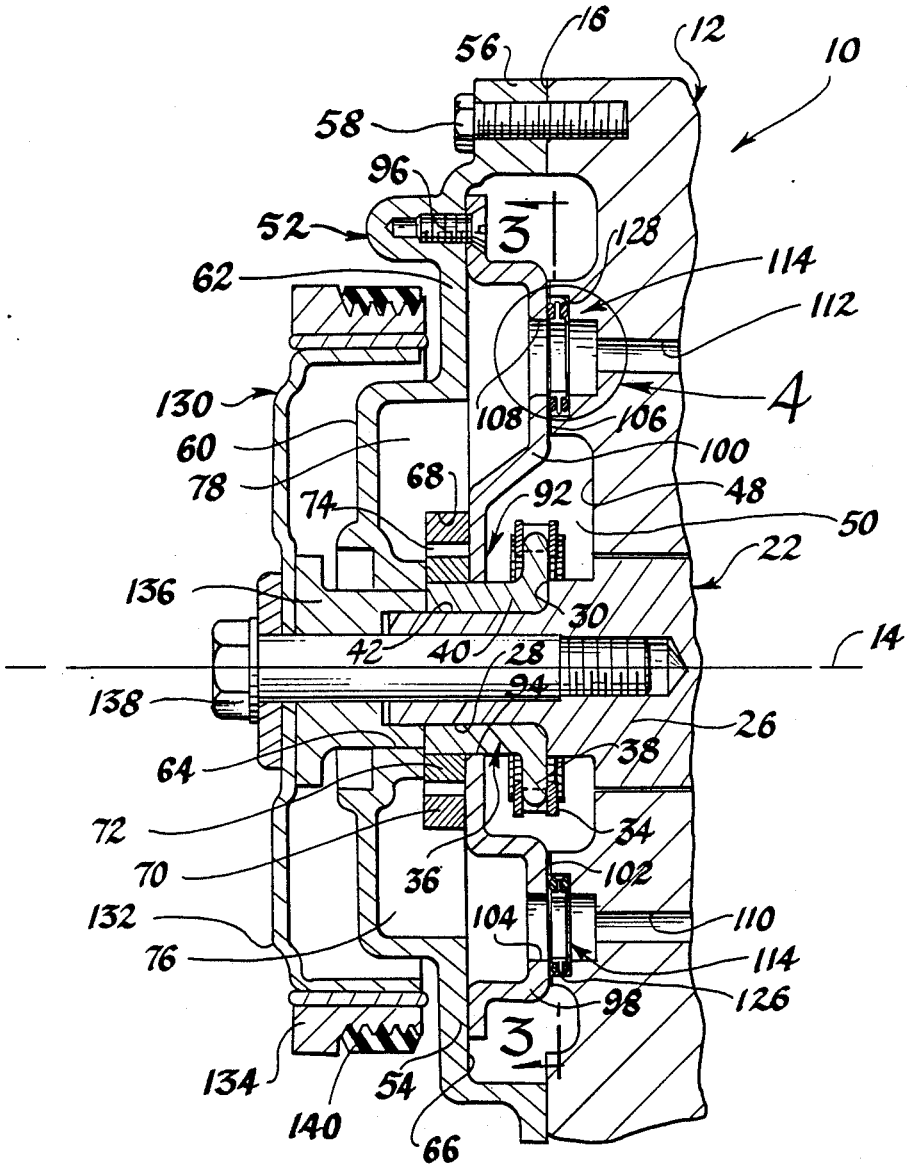
FIG. 2 is a sectional view taken generally along the plane indicated by lines 2—2 in FIG. 1.

In its installed position, the sprocket 36 is disposed generally in a vertically extending depression 48, FIG. 2, in the front face 16 of the cylinder block. The chain 34 is looped over the sprocket 36 and over a sprocket, not shown, on the camshaft and is disposed in a plane substantially parallel to the plane of the front face 16 of the cylinder block. The chain and the sprockets are disposed in a drive chain chamber 50 defined by the cylinder block and a front cover 52 of the engine.

As seen best in FIGS. 1 and 2, the front cover 52 is a generally rectangular member having a front wall 54 and an integral raised flange 56 perpendicular to the front wall. The raised flange 56 surrounds the front wall 54 on top and on the two vertical sides and abuts the front face 16 of the cylinder block 12 to close all but the lower end of the drive chain chamber 50. The cover 52 is rigidly attached to the cylinder block by fasteners inserted through the cover into tapped holes in the block, only a representative fastener 58 being illustrated in FIG. 2. The front wall 54 of the cover is substantially parallel to the front face 16 of the cylinder block.

The front cover 52 has a raised annular boss 60 on an outside or exposed surface 62 of the front wall 54. The boss is generally centered on the crankshaft axis 14 and has a crankshaft bore 64 therethrough. An inside or concealed surface 66 of the front wall 54 is counterbored behind the boss 60 to define a cylindrical pump chamber 68, FIGS. 1 and 3, the center of which is offset from the axis 14.

Figure 3:
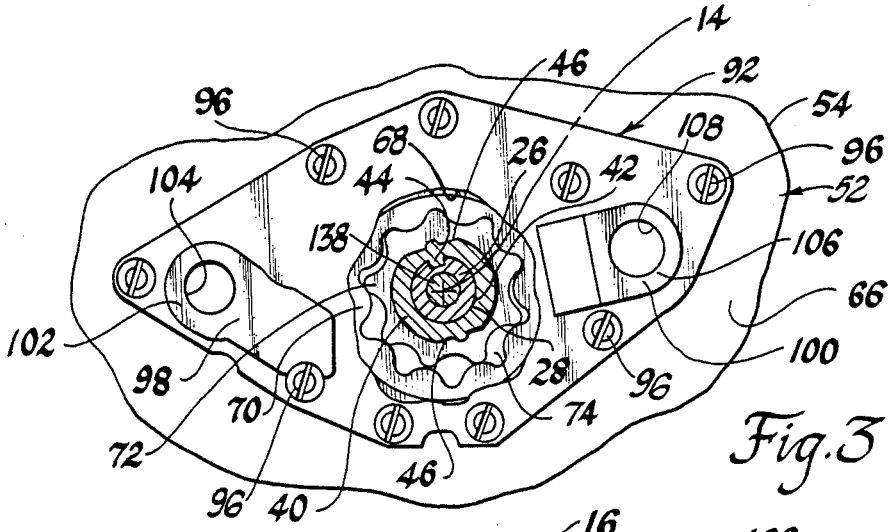
FIG. 3 is a sectional view, partially broken away, taken generally along the plane indicated by lines 3—3 in FIG. 2.

As seen best in FIGS. 1 and 3, a first ring-like internally lobed or toothed oil pump element 70 is rotatably journaled in the pump chamber 68. A second ring-like externally lobed or toothed oil pump element 72 is disposed within the first element 70 and meshes therewith. The second pump element is received over the outside surface 42 of the chain drive sprocket 36. At diametrically opposite locations, the inside surface of the second pump element 72 has fats complementing the flats 46 on the sprocket whereby the second pump element is rotatable as a unit with the sprocket about the crankshaft axis 14. The teeth or lobes of the second pump element 72 mesh with the teeth or lobes of the first pump element 70 in known gerotor or gear pump fashion to define a plurality of variable volume chambers 74 between the teeth or lobes.

The front cover is preferably manufactured as a metal casting so that required fluid passages can be economically formed in the boss 60 adjacent and around the pump chamber 68. For example, the front cover includes an inlet passage 76 and a discharge passage 78 in a generally horizontal plane containing the axis 14, FIG. 2. In addition, the front cover may have a cavity 80 connected for a pressure regulator valve and a drain cavity 82 extending through the boss from a seal groove outside the boss.

As seen best in FIG. 1, a flange 86 on a forward extension of an oil pan 88 of the engine is attached to the bottom of the boss by a fastener 90. The forward extension of the oil pan is below the open lower end of the drive chain chamber 50 so that lubricant in the chamber drains directly into the oil pan.

A generally flat oil pump closure plate 92 abuts the inside surface 66 of the front wall 54 over the pump chamber 68. The stem portion 26 of the crankshaft projects through an aperture 94 in the closure plate. The closure plate 92 cooperates with bottom of the pump chamber 68 in closing the ends of the variable volume chambers 74 defined between the first and second pump elements 70 and 72, respectively, and is fastened to the front cover by a plurality of fastener 96.

As seen best in FIGS. 2 and 3, the closure plate 92 includes a first integral, hollow protuberance 98 and a similar second integral, hollow protuberance 100. The first protuberance 98 has a flat outside wall 102 which is pierced by a port 104. The second protuberance 100 has a flat outside wall 106 which is pierced by a port 108. The first and second protuberances span the depth of the drive chain chamber 50 and straddle the chain 34. Internally, the first protuberance 98 communicates with the inlet passage 76 in the boss 60 and the second protuberance 100 communicates with the discharge passage 78 in the boss. The port 104 in the first protuberance 98 registers with a low pressure gallery 110 in cylinder block 12 which gallery communicates with a pick-up, not shown, in the sump of the oil pan 88 The port 108 in the second protuberance 100 registers with a high pressure gallery 112 in cylinder block 12 which gallery communicates with the pressure lubrication system of the engine. The first and second protuberances thus define inlet and discharge ducts, respectively, through which oil is ducted from the low pressure gallery 110 to the inlet passage 76 and from the discharge passage 78 to the pressure gallery 112.

Figure 4:
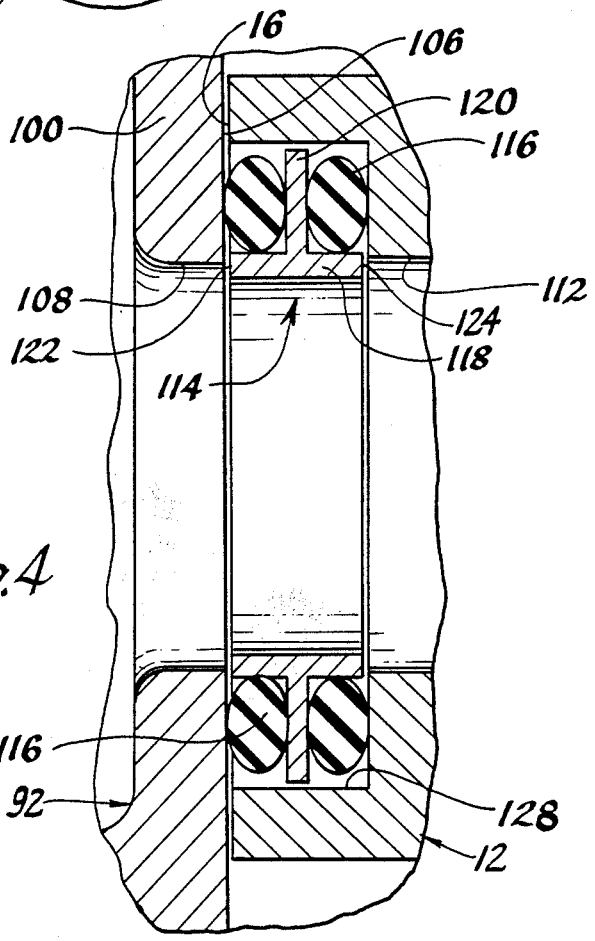
FIG. 4 is an enlarged view of the structure within the circle 4 in FIG. 2.

As seen best in FIGS. 2 and 4, a pair of seal assemblies 114 are disposed between the closure plate 92 and the cylinder block to prevent air ingestion into the intake duct and oil leakage from the discharge duct. Each seal assembly includes a pair of elastomeric seal rings 116 and a cylindrical carrier 118 having an outside radial flange 120 therearound. In their free or natural states, the inside diameter of each seal ring 116 is slightly smaller than the outside diameter of the carrier 118 so that when the rings are slipped over the carrier on opposite sides of the flange 120, each is self-holding. Also, when mounted on the carrier 118, a portion of one of the rings 116 projects beyond a first end 122 of the carrier and a portion of the other of the rings 116 projects beyond a second end 124 of the carrier.

One of the seal assemblies 114 is disposed in a counterbore 126 around the low pressure gallery 110 and the other is disposed in a counterbore 128 around the high pressure gallery 112. The rings 116 project beyond the ends 122 and 124 of the carrier 118 by amounts calculated to produce sealing distortion or flattening of the seal rings against the flat outside walls 102 and 106 when the front cover 52 is fastened to the cylinder block. That is, with the closure plate 92 fastened to the front cover, the flat outside walls 102 and 106 of the first and second protuberances 98 and 100, respectively, press against the exposed ones of the seal rings 116 when the front cover is secured to the cylinder block. The exposed rings are compressed between the outside walls and the flange 120 on the carrier. Likewise, the inside ones of the rings 116 are compressed between the flange 120 and the bottoms of the counterbores 126 and 128. The amount of compression of the rings 116 is calculated to effect fluid tight seals between the closure plate 92 and the cylinder block 12.

Self-retention of the seal rings 116 on the carrier facilitates remote subassembly of the seal assemblies 114 because the seal rings are not easily dislodge from the carrier in transport. In addition, the seal assemblies are easily positioned and retained in the counterbores 126 and 128 without special fixtures before the front cover is installed.

An accessory drive pulley/damper 130 is attached to the distal end of the stem portion 26 of the crankshaft. The pulley damper includes a cup-shaped hub 132 and an annular sheave 134 attached to the hub 132 through an elastomeric medium. The hub 132 is mounted on the stem portion 26 through a rigid extension 136 of the hub and retained by a bolt 138 threaded into a bore in the end of the stem portion. The bolt also serves to capture the chain drive sprocket 36 against the annular shoulder 30 on the crankshaft. The hub 132 envelops the boss 60 on the front cover 52 thereby positioning the sheave 134 immediately adjacent the outside surface 62 of the cover. An accessory drive belt 140 around the sheave 134 is likewise disposed immediately adjacent the exposed surface of the front cover and looped over the sheave.

The embodiments of the invention in which an exclusive property or privilege is claimed are defined as follows:

1. In an engine including a cylinder block having a front wall and a low pressure oil gallery in said front wall and a high pressure oil gallery in said front wall, a front cover attached to said front wall and cooperating therewith in defining a chain drive chamber between said front wall and an inside surface of a generally parallel front wall of said front cover, a crankshaft supported on said cylinder block for rotation about an axis generally perpendicular to said front wall with a front stem portion of said crankshaft projecting through said chain drive chamber and through an aperture in said front cover, a sprocket attached to said crankshaft stem portion within said chain drive chamber, and a drive chain in said chain drive chamber looped around said sprocket, an oil pump comprising:

means on said front cover defining an annular raised boss around said aperture on an outside surface of said front wall of said front cover, means defining a counterbore in said inside surface of said front wall of said front cover behind said raised boss and around said aperture, a first ring-like pump element rotatably supported on said front cover in said counterbore and including internal tooth means, a second ring-like pump element disposed within said first pump element and rotatable as a unit with said crankshaft stem portion and including external tooth means meshing with said internal tooth means of said first pump element, a closure plate on said front cover abutting inside surface of said front wall of said front cover over said counterbore and capturing said first and said second pump elements in said counterbore, means on said closure plate defining a first flat wall around a first port in said closure plate and a second flat wall around a second port in said closure plate, said first port being connected to an intake passage in said annular boss and said second port being connected to a discharge passage in said annular boss, face seal means disposed on said cylinder block around each of said low pressure and said high pressure galleries, said face seal means engaging said first and said second flat walls around said first and said second ports when said front cover is attached to said cylinder block to define fluid seals between said closure plate and said cylinder block around each of said first and said second ports, and a generally cup-shaped pulley disposed substantially around said raised boss and connected to said crankshaft front stem portion for rotation as a unit therewith.

2. In an engine including a cylinder block having a front wall and a low pressure oil gallery in said front wall and a high pressure oil gallery in said front wall, a front cover attached to said front wall and cooperating therewith in defining a chain drive chamber between said front wall and an inside surface of a generally parallel front wall of said front cover, a crankshaft supported on said cylinder block for rotation about an axis generally perpendicular to said front wall with a front stem portion of said crankshaft projecting through said chain drive chamber and through an aperture in said front cover, a sprocket attached to said crankshaft stem portion within said chain drive chamber, and a drive chain in said chain drive chamber looped around said sprocket, an oil pump comprising:

means on said front cover defining an annular raised boss around said aperture on an outside surface of said front wall of said front cover, defining a counterbore in said inside surface of said front wall of said front cover behind said raised boss and around said aperture, a first ring-like pump element rotatably supported on said front cover in said counterbore and including internal tooth means, a second ring-like pump element disposed within said first pump element and rotatable as a unit with said crankshaft stem portion and including external tooth means meshing with said internal tooth means of said first pump element, a substantially planar closure plate attached to said inside surface of said front wall of said front cover over said counterbore and capturing said first and said second pump elements in said counterbore, means on said closure plate defining a first raised protuberance having a first flat wall around a first port in said closure plate, said first port communicating with an intake passage in said annular boss, means on said closure plate defining a second raised protuberance spaced from said first raised protuberance and having a second flat wall around a second port in said closure plate, said second port communicating with a discharge passage in said annular boss, each of said first and said second raised protuberances spanning said chain drive chamber between said front cover and said front wall of said cylinder block and straddling said drive chain when said front cover is attached to said cylinder block, face seal means disposed on said cylinder block around each of said low pressure and said high pressure galleries, said face seal means engaging said first and said second flat walls around said first and said second ports when said front cover is attached to said cylinder block to define fluid seals between said closure plate and said cylinder block around said first and said second ports, and a generally cup-shaped belt pulley disposed substantially around said raised boss and connected to said crankshaft front stem portion for rotation as a unit therewith.

3. The oil pump recited in claim 2 wherein said face seal means disposed on said cylinder block around each of said low pressure and said high pressure galleries includes means on said cylinder block defining a cylindrical counterbore around each of said high pressure and said low pressure galleries, a pair of annular carriers disposed in respective ones of said counterbores each having a cylindrical outer wall and a centrally located circumferential flange extending radially out from said outer wall, a first elastomeric seal ring disposed around each of said carriers on one side of said circumferential flange, said first seal ring having an inside diameter less than the diameter of said cylindrical outer wall so that said first seal ring is self retaining on said carrier and having a cross sectional depth exceeding the distance between said circumferential flange and a corresponding edge of said carrier so that said first seal ring projects beyond said corresponding edge, and a second elastomeric seal ring disposed around each of said carriers on the opposite side of said circumferential flange from said first seal ring, said second seal ring having an inside diameter less than the diameter of said cylindrical outer wall so that said second seal ring is self retaining on said carrier and having a cross sectional depth exceeding the distance between said circumferential flange and a corresponding edge of said carrier so that said second seal ring projects beyond said corresponding edge.

4. The oil pump recited in claim 2 wherein said inside diameter of said first seal ring equals said inside diameter of said second seal ring and each of said first and said second seal rings has a circular cross section of equal diameter.

5. The oil pump recited in claim 3 wherein each of said first and said second raised protuberances is integral with said planar closure plate.

* * * * *